United States Patent [19]

Kleefeldt

[11] 4,440,006

[45] * Apr. 3, 1984

[54] ANTITHEFT CENTRAL LOCK SYSTEM FOR A MOTOR VEHICLE

[75] Inventor: Frank Kleefeldt, Heiligenhaus, Fed. Rep. of Germany

[73] Assignee: Kiekert GmbH & Co. Kommanditgesellschaft, Heiligenhaus, Fed. Rep. of Germany

[ * ] Notice: The portion of the term of this patent subsequent to Aug. 3, 1999 has been disclaimed.

[21] Appl. No.: 292,792

[22] Filed: Aug. 14, 1981

Related U.S. Application Data

[63] Continuation-in-part of Ser. No. 132,977, Mar. 24, 1980, Pat. No. 4,342,209, and a continuation-in-part of Ser. No. 132,978, Mar. 24, 1980, Pat. No. 4,364,249.

[30] Foreign Application Priority Data

Mar. 24, 1979 [DE] Fed. Rep. of Germany ..... 2911680
Mar. 24, 1979 [DE] Fed. Rep. of Germany ..... 2911681
Aug. 16, 1980 [DE] Fed. Rep. of Germany ..... 3031066

[51] Int. Cl.[3] ..... E05B 53/00

[52] U.S. Cl. ..... 70/264; 70/237; 70/280; 292/DIG. 3; 292/DIG. 23; 292/DIG. 25

[58] Field of Search ..... 70/262–264, 70/280, 283, 237, 256; 292/144, 201, DIG. 3, DIG. 14, DIG. 23, DIG. 25

[56] References Cited

U.S. PATENT DOCUMENTS 3,520,159 7/1970 Swanney ..... 70/264 X
3,653,237 4/1972 DuRocher ..... 70/264
4,135,377 1/1979 Kleefeldt et al. ..... 70/264
4,342,209 8/1982 Kleefeldt ..... 70/264
4,364,249 12/1982 Kleefeldt ..... 70/264

FOREIGN PATENT DOCUMENTS 1177974 9/1964 Fed. Rep. of Germany ..... 70/263
1400006 7/1975 United Kingdom ..... 292/201

*Primary Examiner*—William E. Lyddane
*Attorney, Agent, or Firm*—Karl F. Ross; Herbert Dubno

[57] ABSTRACT

A central door-lock system has a plurality of door latches each including a detent displaceable between an open position securing the respective door to the respective doorpost and a closed position permitting the respective door to separate from the respective doorpost, a manual door-opening handle, mechanism including a primary latch member connected to the handle and connectable to the detent and movable between a lock position preventing this handle from displacing the detent between its open and closed positions and an unlock position permitting the handle to displace the detent between the open and closed positions, and a secondary latch member displaceable between a lock position urging the primary latch member into the respective lock position while permitting the primary latch member to move into the respective unlock position, an unlock position permitting the primary latch member to move freely between the respective lock and unlock positions, and an antitheft position positively holding the primary member in the respective lock position. In addition, respective servoactuators for the latches each include an operator linearly displaceable between lock, unlock, and antitheft positions, an actuator element entrainable by the respective operator, connected to the respective secondary latch member, and jointly displaceable therewith between the respective positions, and a reversible electric servomotor and a rack-and-pinion gear train connected between this motor and the respective operator for displacing the respective secondary latch member via the respective actuator element and operator between the respective lock, unlock, and antitheft positions. A central switch is connected to the servomotors for operating same jointly and thereby jointly displacing the secondary latch members between the respective positions.

10 Claims, 7 Drawing Figures

ANTITHEFT CENTRAL LOCK SYSTEM FOR A MOTOR VEHICLE

CROSS-REFERENCE TO RELATED APPLICATIONS

This application is a continuation-in-part of copending patent applications 132,977 and 132,978 both filed Mar. 24, 1980 (now U.S. Pat. Nos. 4,342,209 and 4,364,249).

FIELD OF THE INVENTION

The present invention relates to a motor-vehicle central lock system. More particularly this invention concerns such a lock system which has a so-called antitheft feature.

BACKGROUND OF THE INVENTION

A central door-lock system normally has at each vehicle door latch a servoactuator basically formed as a reversible servomotor connected through an appropriate link to the respective door latch. This servoactuator is normally connected in parallel to the inside door lock so that it can lock and unlock the door. All of the servomotors are in turn connected to a central switch that is normally incorporated with the inside and outside door locks of the driver's door. Thus when the driver locks or unlocks his door all of the other doors of the vehicle are automatically locked or unlocked. In this manner the driver is spared the effort of walking around the car to lock or unlock the passenger doors.

My above-cited copending application Ser. No. 132,977 describes a central vehicle door-lock system wherein the servoactuators each include an actuator operatively engageable with the respective door-latch detent and displaceable between lock and unlock positions, an operator engageable with the actuator and movable between lock, unlock, and antitheft positions, and a lock pawl displaceable by the respective operator only in the lock position of the respective actuator and in the antitheft position of the respective operator from a freeing position permitting displacement of the respective actuator from the respective lock to the respective unlock position into a blocking position preventing displacement of the respective actuator from the respective lock to the respective unlock position. Link means is provided connected between the detents, actuators, and operators for joint displacement of same between the lock and unlock positions. Each servoactuator has a servomotor connected to the respective operator for displacing same between the respective unlock, lock, and antitheft positions. Control means is connected to the servomotors and includes a switch displaceable between an unlock position for displacing the operators into the respective unlock positions, a lock position for displacing the operators into the respective lock positions, and an antitheft position for displacing the operators into the respective antitheft position. Thus when the switch is in the antitheft position the mechanisms of the door latches cannot displace the detents into the respective unlock positions, as the lock pawls are retaining the operators in the lock position to in turn retain the actuators and detents in the lock positions.

With such a system, therefore, even if for example a window of the vehicle is forced open or one of the vehicle door locks is operated, the respective door cannot be opened because the respective servoactuator will be positively holding the respective door detent in the lock position. In a vehicle with inside door buttons, therefore, these buttons will be locked in the down or lock position so that the door cannot be opened from inside or outside when the system is in the antitheft position. Of course in the lock position of the control switch any of the door latches can be operated by its respective inside or outside door lock independently of the other latches.

My second above-cited application relates to an arrangment having door latches each of which normally has a detent lockingly engageable with a bolt or pin on the respective doorpost and displaceable between open and closed positions respectively allowing the door to be separated from the respective doorpost and securely holding the door to its respective post. Mechanism inside the latch allows this detent to be operated by inside and outside door handles, and this mechanism itself is normally controlled by inside and outside door locks that allow the inside and outside door handles to be uncoupled from the detent. Thus when the door is locked it cannot be opened from either the inside or outside handle, and this locking can be carried out either by means of an externally accessible key-operated door lock or by means of an internal lock button or lever. Each such latch in a central system is associated with a respective servoactuator as described above.

My application Ser. No. 132,978 cited above is aimed at a central door-lock system having door latches of the type described immediately above, but having a detent and a manual door-opening handle as well as primary and secondary latch members. The primary latch member is connected to the handle and is connectable to the detent and movable between a lock position preventing the handle from displacing the detent between the open and closed positions and an unlock position permitting the handle to displace the detent between the open and closed positions. The secondary latch member is displaceable between a lock position urging the primary latch member into the respective lock position, an unlock position permitting the primary latch member to move between the respective lock and unlock positions, and into an antitheft position positively holding the primary member in the respective lock position. The servoactuators each have an actuator element connected to the respective secondary latch member and a servomotor that displaces the respective secondary latch member via the respective actuator element between the respective lock, unlock, and antitheft positions. A central switch is connected to all of these servomotors to operate same jointly and thereby jointly displace the secondary latch members between the respective positions.

Thus in accordance with my earlier invention the secondary latch member merely urges the primary latch member into the lock position, so that, even if the central lock system is in the lock position so that all doors are locked, it is possible to manually unlock any one of the doors without having to unlock them all, this door however automatically relocking itself the instant pressure is released from the inside or outside door lock. In the antitheft position, however, the secondary member positively holds the primary member in the lock position so that it is impossible to open the door latch either from inside or outside.

My above-described systems have various advantages and disadvantages. The use of a nut and threaded spindle connection for displacing the operator has a high mechanical advantage, but is relatively slow. On the other hand the directly coupled systems present the danger of being broken if they are forced either intentionally or inadvertently.

OBJECTS OF THE INVENTION

It is therefore an object of the present invention to provide an improved central door-lock system.

Another object is to provide a system which is an improvement on my above-described systems.

SUMMARY OF THE INVENTION

These objects are attained according to the instant invention in a central door-lock system comprising a plurality of door latches each including a detent displaceable between an open position securing the respective door to the respective doorpost and a closed position permitting the respective door to separate from the respective doorpost, a manual door-opening handle, mechanism including a primary latch member connected to the handle and connectable to the detent and movable between a lock position preventing this handle from displacing the detent between its open and closed positions and an unlock position permitting the handle to displace the detent between the open and closed positions, and means including a secondary latch member displaceable between a lock position urging the primary latch member into the respective lock position while permitting the primary latch member to move into the respective unlock position, an unlock position permitting the primary latch member to move freely between the respective lock and unlock positions, and an antitheft position positively holding the primary member in the respective lock position. The system of this invention also includes respective servoactuators for the latches each including an operator linearly displaceable between lock, unlock, and antitheft positions, an actuator element entrainable by the respective operator, connected to the respective secondary latch member, and jointly displaceable therewith between the respective positions, and means including a reversible electric servomotor and a rack-and-pinion gear train connected between this motor and the respective operator for displacing the respective secondary latch member via the respective actuator element and operator between the respective lock, unlock, and antitheft positions. Finally the system of this invention has means including a central switch connected to the servomotors for operating same jointly and thereby jointly displacing the secondary latch members between the respective positions.

According to further features of this invention means is provided for positively mechanically locking the actuator element in the respective antitheft position. This means comprises a lock pawl displaceable by the respective operator only in the lock position of the respective actuator element and in the antitheft position of the respective operator from a freeing position permitting displacement of the respective actuator element from the respective lock to the respective unlock position into a blocking position preventing displacement of the respective actuator element from the respective lock to the respective unlock position. Thus with the system according to the instant invention the door latch can be positively locked at the servoactuator.

According to yet another feature of this invention, the actuator element is formed with a recess of predetermined length measured in the linear direction of displacement of the operator and has a subelement linearly slidable in said recess and provided with an engagement projection engageable by the operator. This servoactuator further has an abutment engageable with its subelement in the lock and antitheft positions of the actuator element. The engagement projection is depressable by the actuator element.

DESCRIPTION OF THE DRAWING

The above and other features and advantages will become more readily apparent from the following, reference being made to the accompanying drawing in which.

SPECIFIC DESCRIPTION

Figure 1:
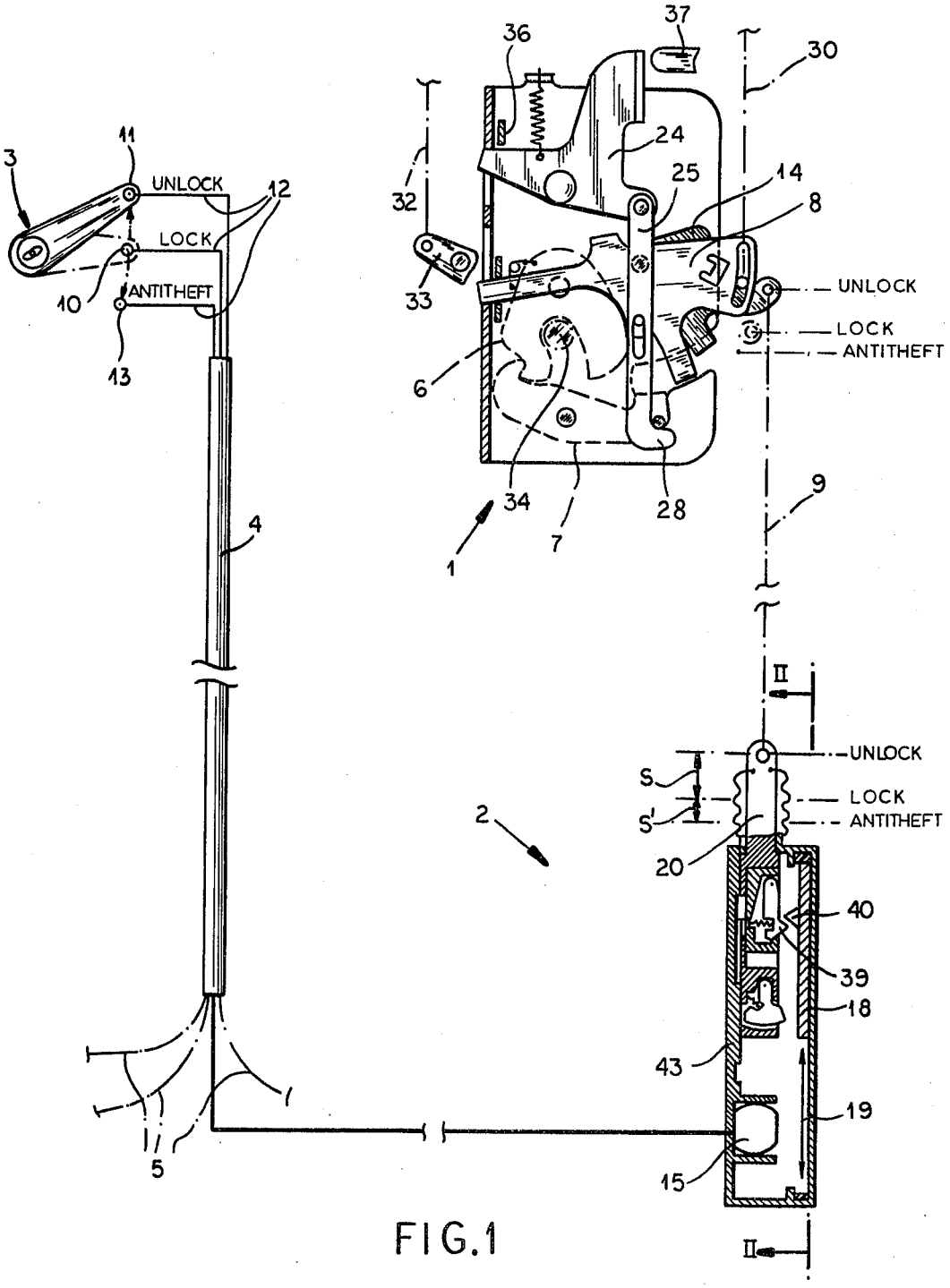
FIG. 1 is a small-scale partly schematic view of the central locking system according to the present invention.

A central motor-vehicle lock system according to the instant invention as shown in FIG. 1 is provided at each of its doors with a door latch 1 operable by a reversible servoactuator 2 operable in turn by means of a key-operated switch 3 that may be incorporated in the door latch 1 for the front-seat driver's door and may be of the type described in commonly owned application 154,225 filed Mar. 29, 1980 (now U.S. Pat. No. 4,320,639, 3/23/82). A cable 4 leads from the key-operated switch 3 and has a plurality of branches 5 each connected to a respective one of the door latches 1. In addition to having a latch 1 on each of the doors, it is possible to provide such latches for the trunk and hood also, with unnecessary mechanism in such latches being eliminated.

Each latch 1 is mounted on the respective motor-vehicle door and has a standard detent fork 6 engageable with a bolt or pin 34 extending out of the respective doorpost. A pivotal locking pawl 7 in each latch 1 can retain the respective detent fork 6 in a position locking the respective bolt 34 in the latch 1 and can be retained in the illustrated lock position or moved out of it indirectly by a main latch member 8 connected via a rigid rod constituting a link 9 with the respective servoactuator 2.

The switch 3 has a lock contact 10, an unlock contact 11, and an antitheft contact 13 connected to respective conductors 12 leading to respective branches 5 of the cable 4. It is possible for this switch 3 merely to be integrated in the key-operated mechanism of the driver's door lock. One may also provide a completely separate switch which has the antitheft position, that is which incorporates the antitheft contact 13 whereas the other contacts 10 and 11 are incorporated in the driver's door switch. It is also frequently advantageous to combine the antitheft switch or position with a burglar-alarm switch, if the vehicle is provided with such an alarm, as then the car has two styles of theft protection which are enabled simultaneously. In any case, the switch is set up so that it can only be moved into the antitheft position by means of a key from outside the motor vehicle after intentionally locking its doors. The possibility of accidentally locking someone inside the vehicle is thereby eliminated.

Figure 2:
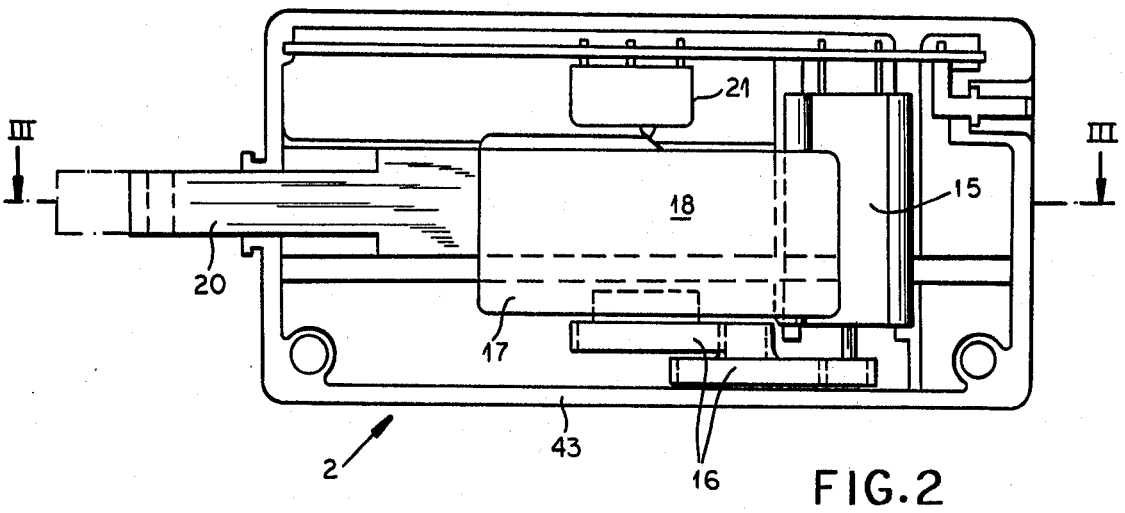
FIG. 2 is a large-scale section taken along line II—II of FIG. 1.

The servoactuator 2 basically has a slider 20 connected via the link 9 as described above with the main latch member 8. This slider 20 can in turn be displaced longitudinally inside the actuator housing 43 by means of a slidable operator 18 best shown in FIGS. 2–4. The operator 18 is displaceable between offset lock, unlock, and antitheft positions, and is displaceable linearly through a stroke S from the unlock to the lock position and through a stroke S' from the lock to the antitheft position, as determined by the position of the switch 3.

More particularly the slidable operator 20 has a projection 40 engageable with a pivotal lever 39 of the slider 20. This lever 39 is received in a recess 19 of a slidable insert or subelement 38 in turn received in a recess or cutout 35 of the slider 20. Since this recess 19 is longer by a distance d in the direction of displacement of the operator 18 and actuator 20 than the subelement, this subelement 38 can move limitedly longitudinally relative to the slider 20. The back side, that is the side turned away from the lever 39, of the element 38 is provided with a projection 41 that extends through a window in the back of the slider 19 and is engageable with an abutment or shoulder 42 of the housing 43.

A relatively stiff compression spring 47 is braced between the back of the lever 39 and the bottom of the recess 19 and urges this lever 39 outward. The force exerted by the compression spring 47 is sufficient that longitudinal vertical displacement of the slidable operator 18 can entrain the slider 20 through the stroke S between the lock and unlock positions.

Figure 3:
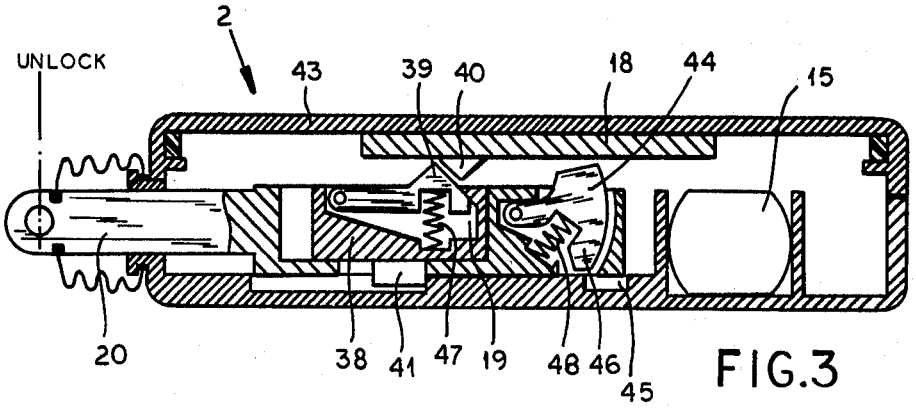
FIG. 3 is a section taken along line III—III of FIG. 2.
Figure 4:
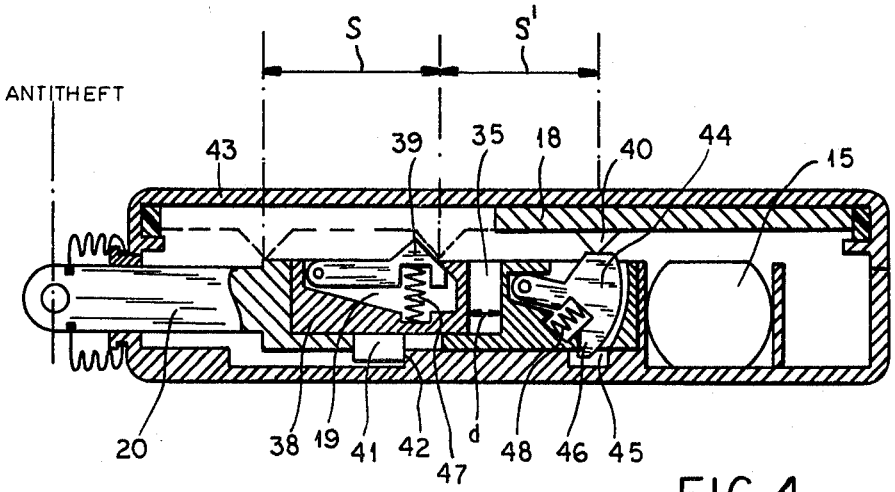
FIG. 4 is a view similar to FIG. 3 showing the system in another position.
Figure 5:
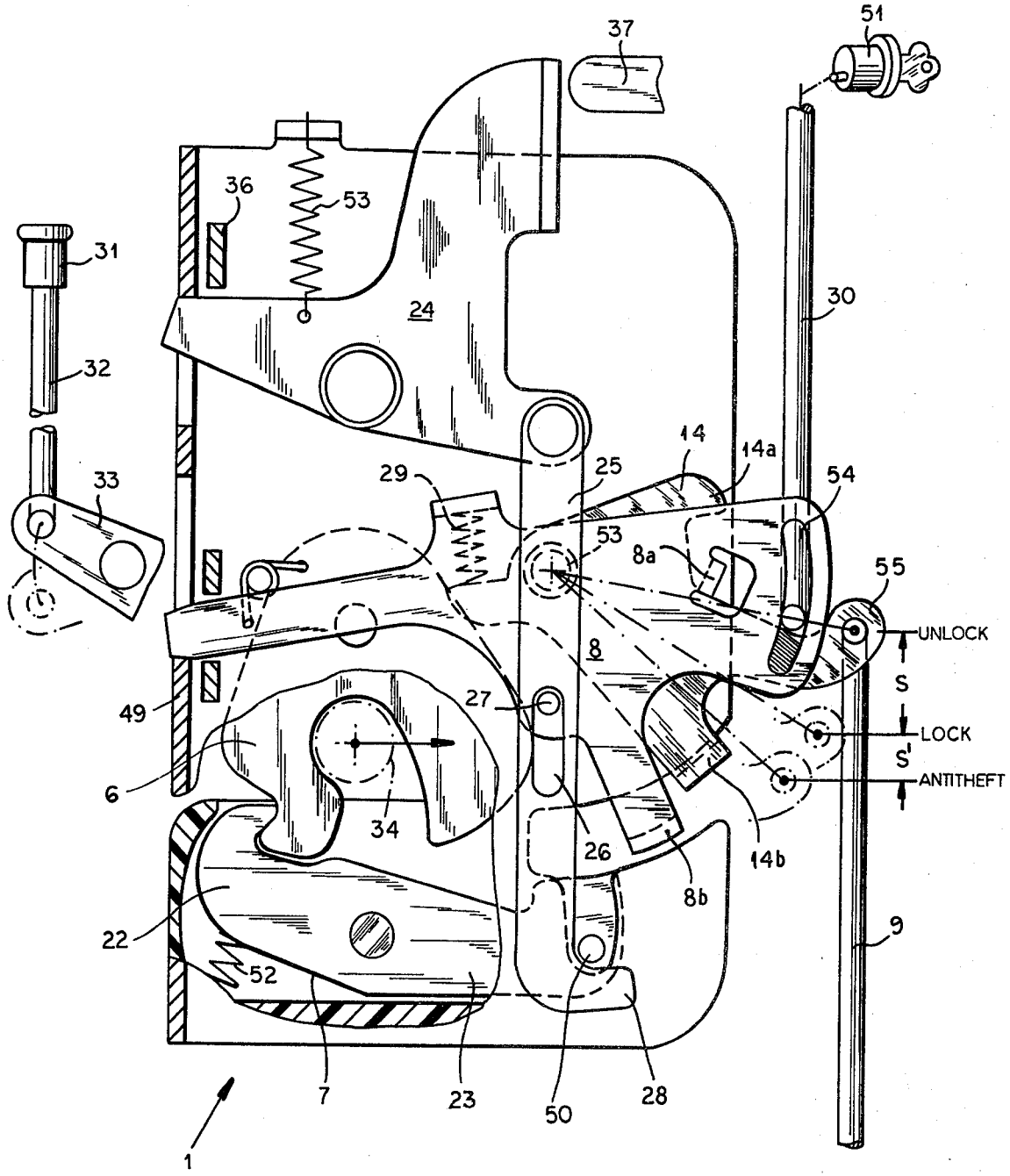
FIG. 5 is a large-scale view of the latch in the unlock position.

The slider 20 is also provided with a pivotal locking pawl 44 that has one side turned forwardly toward the slidable operator 18 and that is biased toward this operator 18 by means of a spring 48. In fact the pivot for the pawl 44 is provided above its center and the pawl 44 is so constructed that even absent the spring 48 it would naturally pivot up as seen in FIGS. 3 and 4, toward the operator 18. This pawl 44 also has a tooth 46 engageable in a recess 45 formed in the housing 43. When the slide 20 is in the lower lock position, the projection 40 can engage the front face of the pawl 44 and press it backwardly to engage the tooth 46 in the recess 45, thereby solidly locking the slider 20 against linear longitudinal displacement in the housing 43. Obviously such locking also effectively prevents the member 8 of the latch 12 from moving, as the link 9 between this member 8 and the slidable actuator element 20 is a rigid rod.

The main latch member 8 can be moved into this lock position by depressing an inside door-lock button 31 connected via a rod 32 to a lever 33 that acts directly on an arm of the member 8. In addition operation of an outside door cylinder 51 will lower a rod 30 having an end engaged in a slot 54 in the member 8. The end of the rod 30 also engages the upper edge of the arm 55 of the actuating element 14 so that it will also pivot this element 14 clockwise and will bear via the spring 29 in the clockwise direction on the member 8 to pivot it into the lock position. In this lock position a tab **8*b* extending downward and inward from the member 8 will be aligned with the upper edge of the arm 23 of the pawl 7 so that upward displacement of the arm 23 and, therefore, counterclockwise pivoting of the pawl 7 will be impossible. This action effectively locks the latch 1. Once the element 14 pivots fully around in the clockwise direction the lower end of the rod 30 will bear directly against the element 8** to pivot it into the lock position.

Figure 7:
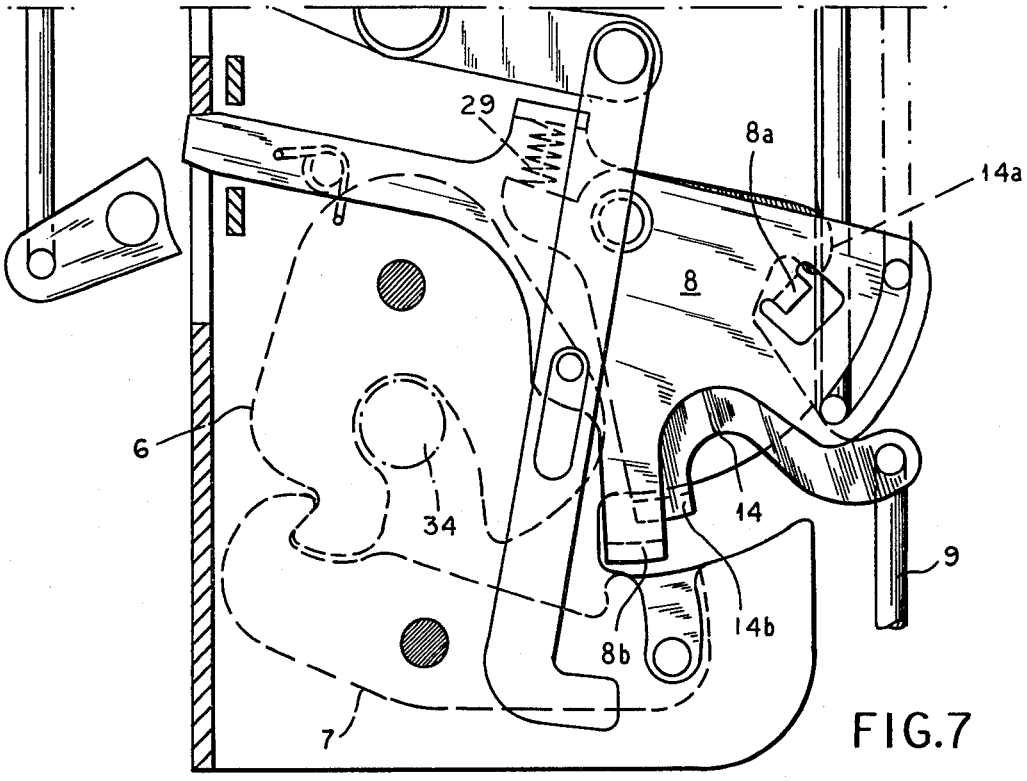
FIG. 7 is a view like FIG. 5 but showing the latch in the antitheft position.
Figure 6:
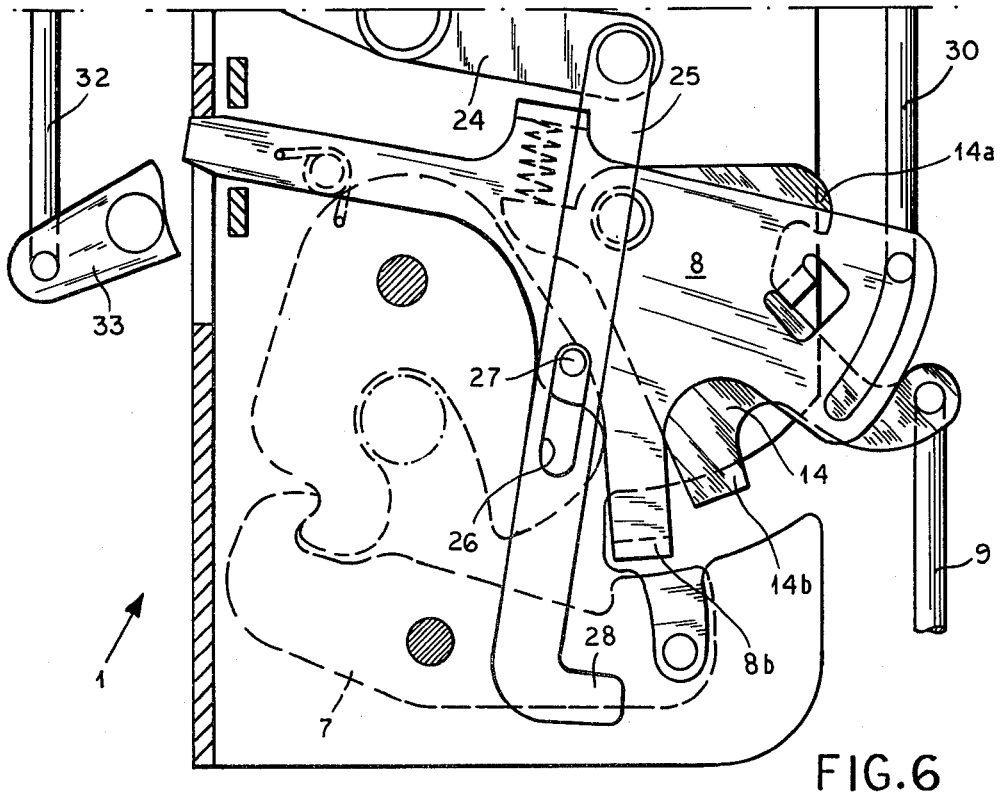
FIG. 6 is a view like FIG. 5 but showing the latch in the lock position.

When the switch is operated to close the switch 18 and displace the rod 9 into the antitheft position, which can only be done after displacing the mechanism into the lock position, a nose **14*a* seen in FIG. 7 will come into direct contact with a tab 8*a* of the element 8 and will positively retain the element 8 in the lock position. What is more a tab 14*b* of the element 14 aligns itself in this position with the tab 8*b* to further prevent upward displacement of the arm 23 of the pawl 7. Therefore on displacement of the element 14 through the stroke S from the unlock to the lock position the spring 29 serves to transmit torque that also displaces the latch member 8 from the unlock to the lock position. On displacement from the lock to the antitheft position through the storke S', however, the element 14 positively and physically engages the element 8** to move it onto and hold it positively in the lock position.

For this reason although it is possible to unlock the door when the parts of its latch are in the lock position by means either of the outside door cylinder 51 or the inside door button 31, when in the antitheft position neither of these actuators can operate the latch. In the antitheft position the projection 40 is pushing the tooth 46 into the recess 45, so that the entire system is locked up. Even if the tooth 46 were broken off, it would take an enormous force to reverse drive the slider 20 which is connected through the gear train 16 to the still motor 15. In other words the only way to get the system out of the antitheft position without operation of the motor requires physical destruction of the various parts.

The lock system of the instant invention therefore has all of the advantages of a standard central locking system—the ability to lock and unlock all of the doors from a single location—but it also provides a level of theft protection that has hitherto been unobtainable. The extra mechanism needed to provide this extra degree of protection does not appreciably increase the cost of the central lock system.

I claim:

1. A central door-lock system comprising:

a plurality of door latches each including a detent displaceable between an open position securing the respective door to the respective doorpost and a closed position permitting the respective door to separate from the respective doorpost, a manual door-opening handle, mechanism including a primary latch member connected to said handle and connectable to said detent and movable between a lock position preventing said handle from displacing said detent between said open and closed positions and an unlock position permitting said handle to displace said detent between said open and closed positions, and means connected to said mechanism and including a secondary latch member displaceable between a lock position urging said primary latch member into the respective lock position while permitting said primary latch member to move into the respective unlock position, an unlock position permitting said primary latch member to move freely between the respective lock and unlock positions, and an antitheft position positively holding said primary member in the respective lock position;

respective servoactuators for said latches each including an operator linearly displaceable between lock, unlock, and antitheft positions, an actuator element entrainable by the respective operator, connected to the respective secondary latch member, and jointly displaceable therewith between the respective positions, and means including a reversible electric servomotor and a rack-and-pinion gear train connected between said motor and the respective operator for displacing the respective secondary latch member via the respective actuator element and operator between the respective lock, unlock, and antitheft positions; and means including a central switch connected to said servomotors for operating same jointly and thereby jointly displacing said secondary latch members between the respective positions.

2. The system defined in claim 1, further comprising means for positively mechanically locking said actuator element in the respective antitheft position.

3. The system defined in claim 2 wherein said means for mechanically locking said actuator element comprises a lock pawl displaceable by the respective operator only in the lock position of the respective actuator element and in the antitheft position of the respective operator from a freeing position permitting displacement of the respective actuator element from the respective lock to the respective unlock position into a blocking position preventing displacement of the respective actuator element from the respective lock to the respective unlock position.

4. The system defined in claim 1 wherein said actuator element is formed with a recess of predetermined length measured in the linear direction of displacement of said operator and has a subelement linearly slidable in said recess and provided with an engagement projection engageable by said operator, said servoactuator further having an abutment engageable with said subelement in said lock and antitheft positions of said actuator element, said engagement projection being depressible by said actuator element.

5. The system defined in claim 1, further comprising a switch operable by said actuator in aid lock and antitheft positions.

6. The system defined in claim 1 wherein each of said latches includes a fork constituting the respective detent, said mechanisms each including a pivotal pawl connected between the respective primary latch members and the respective detents.

7. The system defined in claim 1, wherein the latch members of each latch are pivotal therein about the same axis between the respective positions which are angularly offset from one another, said latches each including a spring braced angularly between the respective latch members, said secondary member of each latch bearing only via the respective spring on the respective primary member in the lock position but bearing positively and directly on the respective primary member in the respective antitheft position.

8. The system defined in claim 7 wherein said secondary members each have a bent-out tab that directly engages the respective primary member in the antitheft position of the secondary member.

9. The system defined in claim 1 wherein said latch members are independently pivotally displaceable relative to each other between the respective lock and unlock positions.

10. The system defined in claim 1 wherein each of said actuator elements has a depressable portion turned toward the respective operator and engageable thereby and biasing means for urging the respective depressable portion outwardly with sufficient force for the respective operator to entrain the respective actuator element on displacement between the respective lock and unlock positions, each of said depressable portions being depressable on displacement of the respective operator from the respective lock to the respective antitheft position.

* * * * *